US007627969B2

(12) United States Patent
Ericson

(10) Patent No.: US 7,627,969 B2
(45) Date of Patent: Dec. 8, 2009

(54) THIN PROFILE ILLUMINATED BI-DIRECTIONAL VISUAL DISPLAY

(75) Inventor: Greg Ericson, Memphis, TN (US)

(73) Assignee: Ericson Group, Inc., Memphis, TN (US)

( * ) Notice: Subject to any disclaimer, the term of this patent is extended or adjusted under 35 U.S.C. 154(b) by 213 days.

(21) Appl. No.: 11/595,793

(22) Filed: Nov. 9, 2006

(65) Prior Publication Data

US 2007/0089345 A1 Apr. 26, 2007

Related U.S. Application Data

(63) Continuation-in-part of application No. 10/395,063, filed on Mar. 25, 2003, now Pat. No. 7,272,902, which is a continuation of application No. 09/973,008, filed on Oct. 10, 2001, now Pat. No. 6,578,301.

(51) Int. Cl.
*G09F 15/00* (2006.01)

(52) U.S. Cl. ..... 40/541; 40/572; 40/609; 40/606; 40/791

(58) Field of Classification Search ..... 40/312, 40/541, 546, 572, 606.01–606.09, 792, 793
See application file for complete search history.

(56) References Cited

U.S. PATENT DOCUMENTS 1,429,211 A 9/1922 Lightburn
1,702,692 A 2/1929 Henderson
1,788,278 A 1/1931 Cortelyou
3,486,261 A * 12/1969 Hardesty ..... 40/546
3,572,045 A 3/1971 Owen
4,125,243 A 11/1978 Liptak
4,380,880 A * 4/1983 Gandy ..... 40/564
4,523,400 A * 6/1985 Seely ..... 40/791
4,586,207 A 5/1986 Cornette
4,773,622 A 9/1988 Herlin
4,885,860 A * 12/1989 Huenefeld ..... 40/607.03
5,295,500 A 3/1994 Leu
5,397,125 A 3/1995 Adams
5,470,038 A 11/1995 Clark
5,555,654 A * 9/1996 Hermann ..... 40/714
5,579,599 A 12/1996 Haeseler
5,634,286 A * 6/1997 Johnson ..... 40/564
5,682,696 A 11/1997 Gill
5,799,767 A 9/1998 Molbak (Continued)

OTHER PUBLICATIONS

Declaration Regarding Use and Sale of Visual Display by Greg Ericson, dated Jul. 19, 2006, 8 pages.

(Continued)

*Primary Examiner*—Lesley D Morris
*Assistant Examiner*—Shin Kim
(74) *Attorney, Agent, or Firm*—Weide & Miller, Ltd.

(57) ABSTRACT

A visual display has front and rear display panels and a surrounding frame. The display is configured to be supported by and between rows of gaming machine by first and second downwardly extending support legs, the legs each having transverse stop plates extending in cantilever manner from opposite sides of the vertical support legs at a position spaced above the lower ends of the legs. The frame supports pivotal clamps for clamping signage over the display panels. In one embodiment, the display panels are illuminated. In a thin configuration of the sign, the front and rear panels are arranged back-to-back and are edge lit.

17 Claims, 13 Drawing Sheets

U.S. PATENT DOCUMENTS

| | | | | |
|---|---|---|---|---|
| 5,813,927 | A | 9/1998 | Anglea | |
| 5,815,971 | A | 10/1998 | Rothe et al. | |
| 5,829,177 | A * | 11/1998 | Hjaltason | 40/546 |
| 6,015,124 | A | 1/2000 | Loy | |
| 6,449,888 | B1 | 9/2002 | Gibbs | |
| 6,481,131 | B2 * | 11/2002 | Gianotti et al. | 40/546 |
| 6,578,301 | B1 | 6/2003 | Ericson | |
| 6,718,671 | B1 * | 4/2004 | Cluff | 40/611.03 |
| 7,278,770 | B2 * | 10/2007 | Lu | 362/604 |

OTHER PUBLICATIONS

Supplemental Declaration of Greg Ericson Regarding Use and Sale of Visual Display, dated Oct. 24, 2006, 5 pages.

* cited by examiner

THIN PROFILE ILLUMINATED BI-DIRECTIONAL VISUAL DISPLAY

CROSS REFERENCE TO RELATED APPLICATIONS

This application is a continuation-in-part of U.S. application Ser. No. 10/395,063, filed Mar. 25, 2003 now U.S. Pat. No. 7,272,902, which is a continuation of U.S. application Ser. No. 09/973,008, filed Oct. 10, 2001, now U.S. Pat. No. 6,578,301. The entire disclosures of each above-listed application and patent are hereby incorporated by reference herein.

FIELD OF THE INVENTION

The present invention relates to visual display devices and, more particularly, to a thin, illuminated bi-directional visual display which is particularly suited for use with gaming machines.

BACKGROUND OF THE INVENTION

One contemplated usage of the present invention is in connection with back-to-back rows of slot machines; however, usage of the subject invention is not limited to slot machines since the invention has equal applicability for usage with other types of vending machines, including but not limited to, merchandise display cabinets and the like.

The field of signs and display devices is replete with devices providing back-to-back or double-sided displays of information such as exemplified in U.S. Pat. Nos. 5,579,599 and 5,682,696. Other prior devices such as U.S. Pat. Nos. 1,429,211, 5,295,500 and 5,799,767 are directed to various types of apparatus for attaching a sign to supporting structures such as posts, automobiles and the like. Similarly, the use of signs with gaming devices such as slot machines is well known and is exemplified in U.S. Pat. No. 5,397,125 in which a forwardly-facing sign is provided on fixedly extending vertical pipes attached to the base on which the slot machine rests. However, the prior art is devoid of any teaching of double-sided signs or other display materials which can be easily changed and in which a single sign is visible by users of two back-to-back gaming machines while being easily replaceable without need for mechanical connection or disassembly of any sort.

Therefore, there remains an unmet need for display assemblies or apparatus, which can be easily associated with or removed from association with back-to-back machines such as gaming machines or the like without there being any need for mechanical connection, disconnection or other time consuming and expensive procedures.

Therefore, it is the primary object of the present invention to provide a new and improved display apparatus for mounting on back-to-back gaming or other devices, which can provide messages to persons viewing such devices from the front of either of the devices.

A further object of the present invention is the provision of a new and improved sign assembly, which can be positioned on and supported in stable manner between two rows of devices arranged in back-to-back manner.

Yet another object of the present invention is to provide a new and improved back-lit display apparatus for mounting on back-to-back gaming or other devices, which can provide messages to persons viewing such devices from the front of either of the devices.

An additional object of the present invention is the provision of a new and improved ultra-thin back-lit sign assembly, which can be positioned on and supported in a stable manner between two rows of devices arranged in back-to-back manner.

Yet another object of the present invention is the provision of a new and improved display means having leg-type supports resting on the tops of back-to-back devices and including means engaging such devices for providing horizontal stability.

An improved ultra-thin bidirectional visual display for use with back-to-back game devices is desired that provides an illuminated visual display that is visible from the front of each device, and further provides structural stability for the visual display.

SUMMARY OF THE INVENTION

The present invention comprises visual display devices. In a preferred configuration, the display devices are configured for location at the top of gaming or vending machines which are arranged in back-to-back configuration.

In one embodiment, a display of the invention is supported by first and second vertical legs. The legs preferably include transverse stop plates extending in cantilever manner from opposite sides thereof. The stop plates are positioned above the lower end of each leg to permit the lower end of each leg to extend downwardly into an open space or valley between back-to-back rows of gaming or vending machines, while the stop plates rest upon the tops of the gaming or vending machines.

At least one visual display element or support comprising a panel, board or the like is supported by the legs, such as at their upper ends. In one embodiment, the one or more display elements are supported by a frame. In one embodiment, the display includes two panels, one at the front of the display and one at the back, so that the display is "bi-directional."

The display frame may include clamp frame members which are openable to receive and clamp posters, signs or the like over or at outwardly facing surfaces of the display elements so that such signs are visible at both sides of the display, such as to users of either row of vending or gaming machines.

In one embodiment of the invention, the display is back-lit. In one configuration, the display elements may comprise generally translucent panels which are spaced apart. One or more light sources, such as fluorescent light tubes, are located between the panels for illuminating the panels and signage located at the front of the panels, such as transparency type posters, signs or the like.

In a thin-profile configuration of the display, the display panels or supports are arranged in back-to-back configuration. In an illuminated embodiment, the display panels are edge-illuminated, such as by one or more cold-cathode flourescent light sources. In this configuration, the display panels may include interior grooving for reflecting edge-emitted light towards a reflective sheet or surface located at a rear face of the panels (such as a reflective sheet located between the back-to-back panels), which sheet or surface reflects the light towards a front of the panel.

Further objects, features, and advantages of the present invention over the prior art will become apparent from the detailed description of the preferred embodiments which follows, when considered with the accompanying figures.

DETAILED DESCRIPTION OF THE INVENTION

Figure 2:
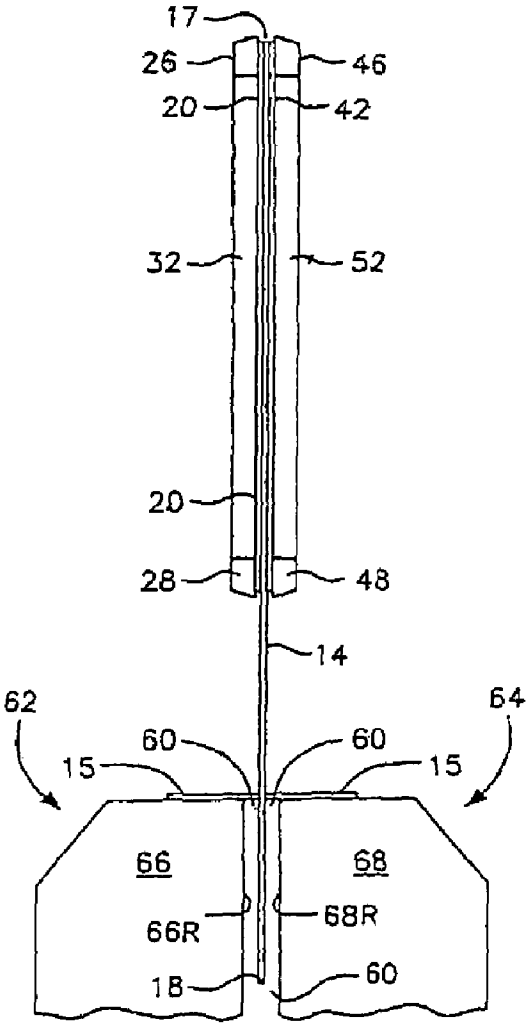
FIG. 2 is a right side elevation of the display illustrated in FIG. 1.
Figure 1:
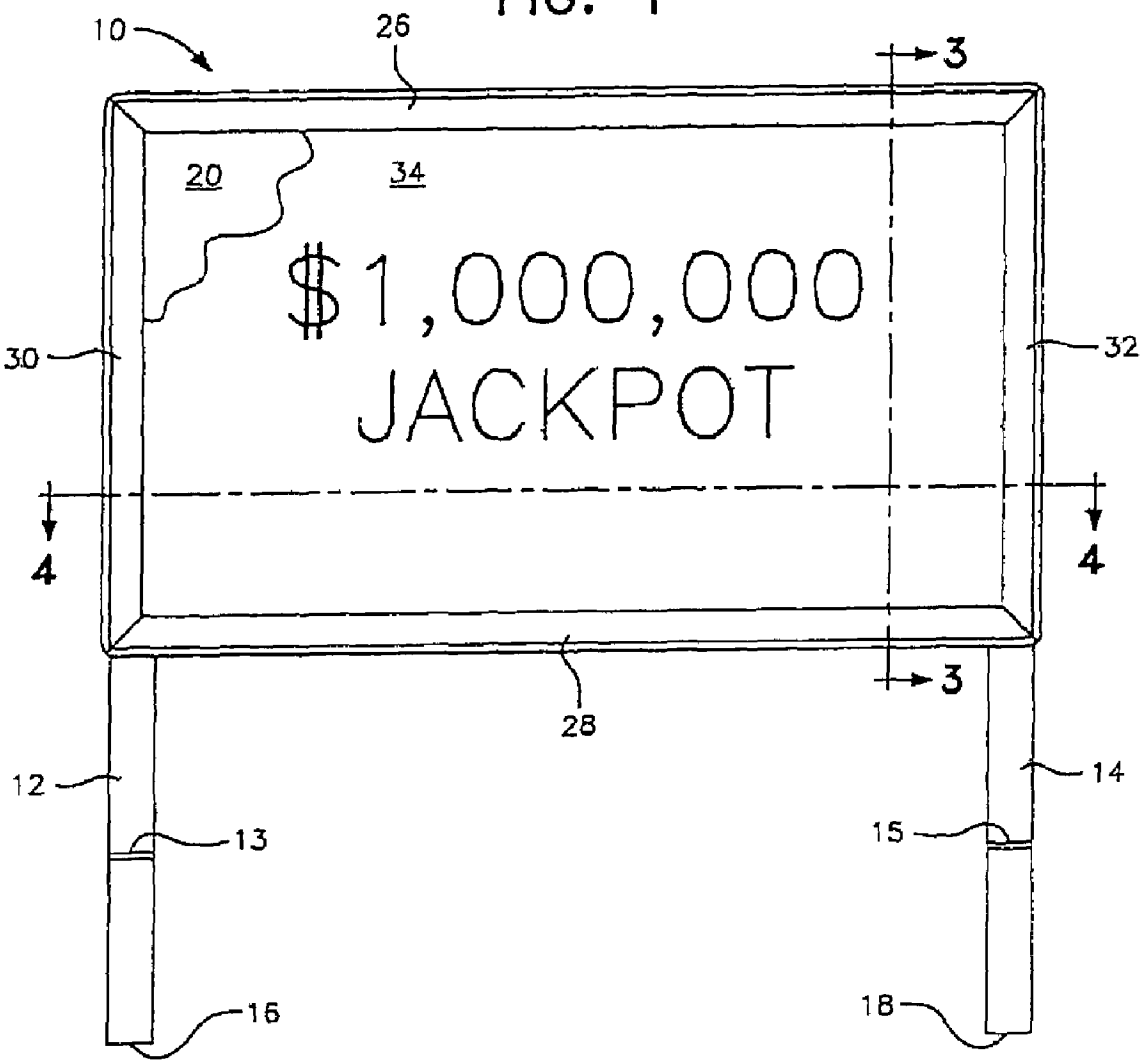
FIG. 1 is a front elevation of a non-illuminated display in accordance with a first embodiment of the invention.
Figure 3:
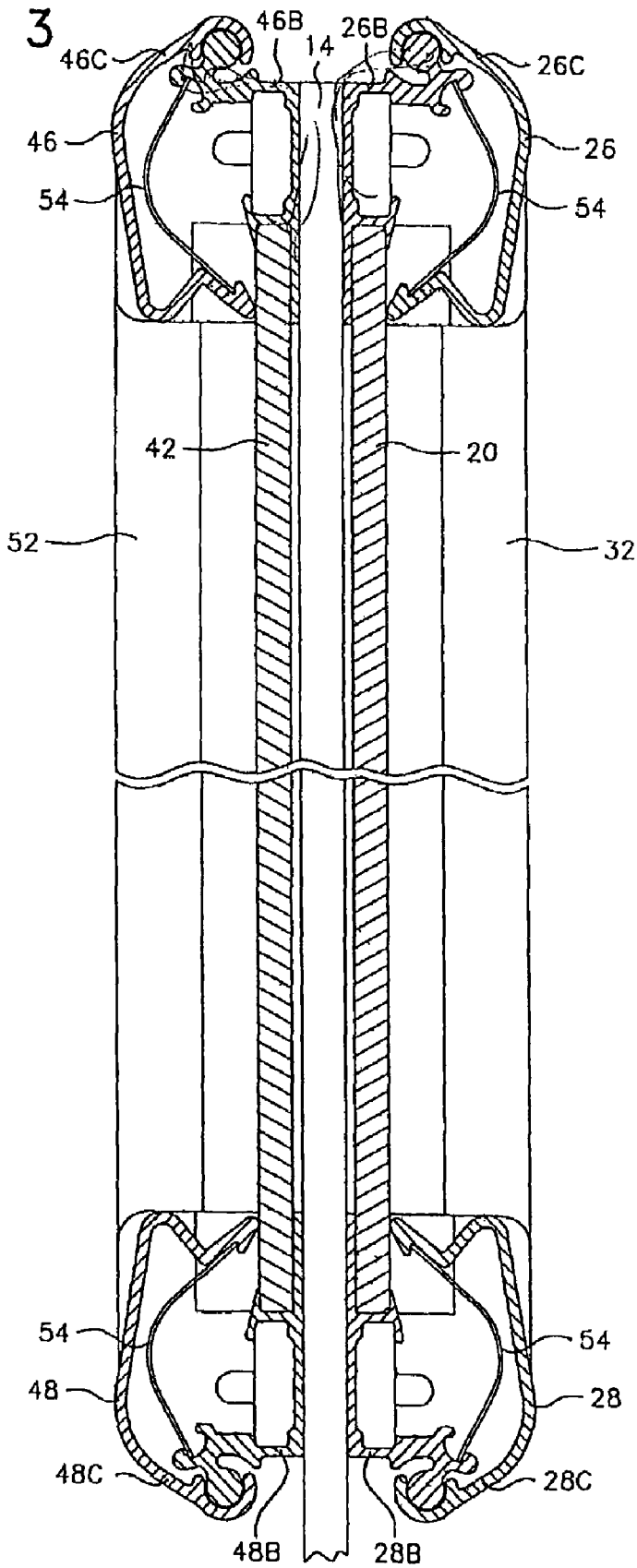
FIG. 3 is a sectional view of the display illustrated in FIG. 1 taken along line 3-3 thereof.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

FIGS. 1-4 illustrates a two-sided, non-illuminated display 10 in accordance with one embodiment of the invention. As illustrated, the display 10 includes a first or left vertical leg 12 and a second or right vertical leg 14. The legs 12,14 are preferably identical to each other and may be formed of vertical steel or other metal plate material. The first vertical leg 12 has a lower end 16 and the second vertical leg 14 similarly has a lower end 18. The first vertical leg 12 has two horizontally aligned transverse stop plates 13 extending from it in opposite directions (only one stop plate is shown in the drawings).

The second vertical leg 14 is identical to first vertical leg 12 and has two transverse stop plates 15 which extend outwardly perpendicular to vertical leg 14 and also has an upper end 17 as shown in FIG. 2. The first vertical leg similarly has an upper end, which is not shown. First vertical leg 12 is identical to second vertical leg 14 and the end elevation view taken from the left side of the device of FIG. 1 would be structurally identical to FIG. 2. It should also be noted that a rear elevation view of the preferred embodiment would be identical to the front elevation view of FIG. 1 with the exception of the fact that the position of vertical legs 12 and 14 would be reversed.

A front sheet display support panel 20 formed of fiber board or the like is supported in a rectangular front border frame which is attached to the front surfaces of the first vertical leg 12 and the second vertical leg 14 and has an upper edge approximately coextensive with the upper end 17 (FIG. 2) of vertical leg 14 and the corresponding upper end of leg 12. The front border frame comprises a horizontal upper clamp frame assembly 26, a horizontal lower clamp frame assembly 28, a left vertical clamp frame assembly 30 and a right vertical clamp frame assembly 32 which enables retention of a front display sheet 34 on display support panel 20. The display sheet is formed of paper, cardboard, metal, plastic or the like and provides a desired visual message. Sheet 34 has been omitted from FIGS. 3 and 4 for purposes of clarity.

Figure 4:
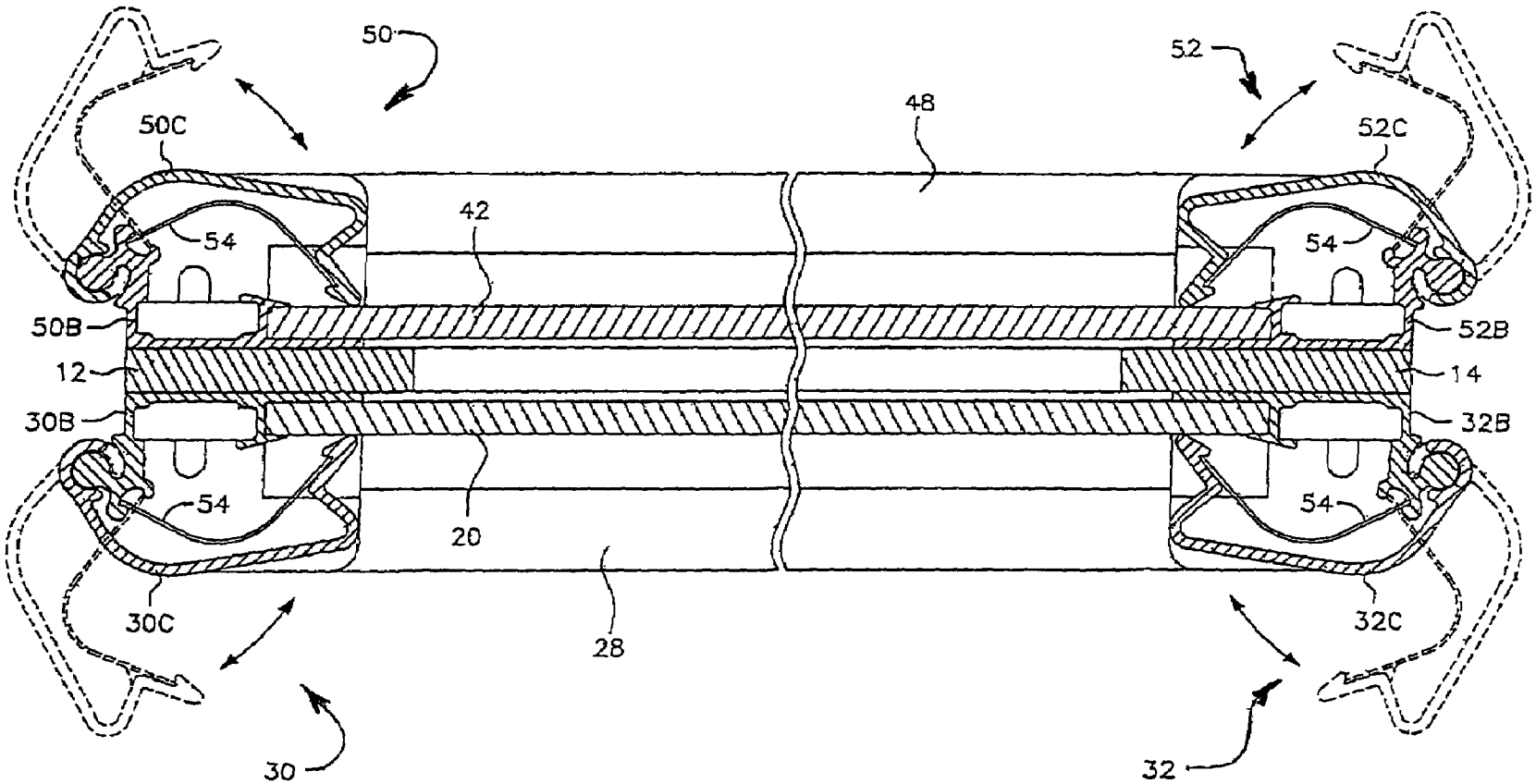
FIG. 4 is a sectional view of the display illustrated in FIG. 1 taken along line 4-4 thereof.

Similarly, a rear sheet display support panel 42 (FIG. 2) formed of fiber board or the like is horizontally aligned with the front sheet display support panel 22 and is supported in a rectangular rear border frame which is identical to the front border frame and is attached to the rear surfaces of the upper portions of the vertical legs 12 and 14. The rear border frame comprises a rear upper horizontal clamp frame assembly 46, a rear lower horizontal clamp frame assembly 48 (FIG. 3), a left rear vertical clamp frame assembly 50, and a right rear vertical clamp fame assembly 52 (FIG. 4). The aforementioned rear clamp frame assembly components are identical to the clamp frame components 26, 28, 30 and 32 and enable mounting of a rear display sheet in the same manner as front display sheet 34.

It should be understood that the clamp frame components 26, 28, 30, 32, 42, 46, 48, 50 and 52 are conventional extruded metal which respectively each have base members 26B, 28B, 30B, 32B, 42B, 46B, 48B, 50B and 52B which receive and retain one edge of one of the support panels 20 or 42. The base members pivotally support sheet clamps 26C, 28C, 30C, 32C, 42C, 46C, 50C and 52C. The front base members 26B, 28B, 30B and 32B are attached to the front surfaces of vertical legs 12 and 14 and the rear base members 46B, 48B, 50B and 52B are attached to the rear surfaces of vertical legs 12 and 14. Each of the sheet clamp components 30C, 32C, etc. are biased by an over-center spring 54 into either a clamping position shown in solid lines or an open position shown on dashed lines in FIG. 4. Each spring 54 urges its respective sheet clamp 30C, 32C, etc. to either position when manually moved past an over-center position. The foregoing clamp frame components are indicated by the manufacturer as being covered by one or more of U.S. Pat. Nos. 4,145,828; 4,512,095; 4,519,152; 4,523,400; 4,714,220; 4,937,959 and 4,958,458.

In use, one embodiment of the invention is positioned so that the lower ends of the vertical legs 12 and 14 extend downwardly into an open or valley space 60 (FIG. 2) between back-to-back parallel rows 62 and 64 of vending or slot machines 66 and 68 which respectively have rear surfaces 66R and 68R. The downwardly facing surfaces of the transverse stop plates 13 and 15 are positioned above the bottom ends of vertical legs 12 and 14 a distance which exceeds the width of valley space 60 and rest on the upper surfaces of the rows of devices 66 and 68 to provide support for the display assembly with the lower end portions extending downwardly into the valley providing transverse stability so that the display assembly cannot fall over or create a hazard for persons in the vicinity.

Figure 5:
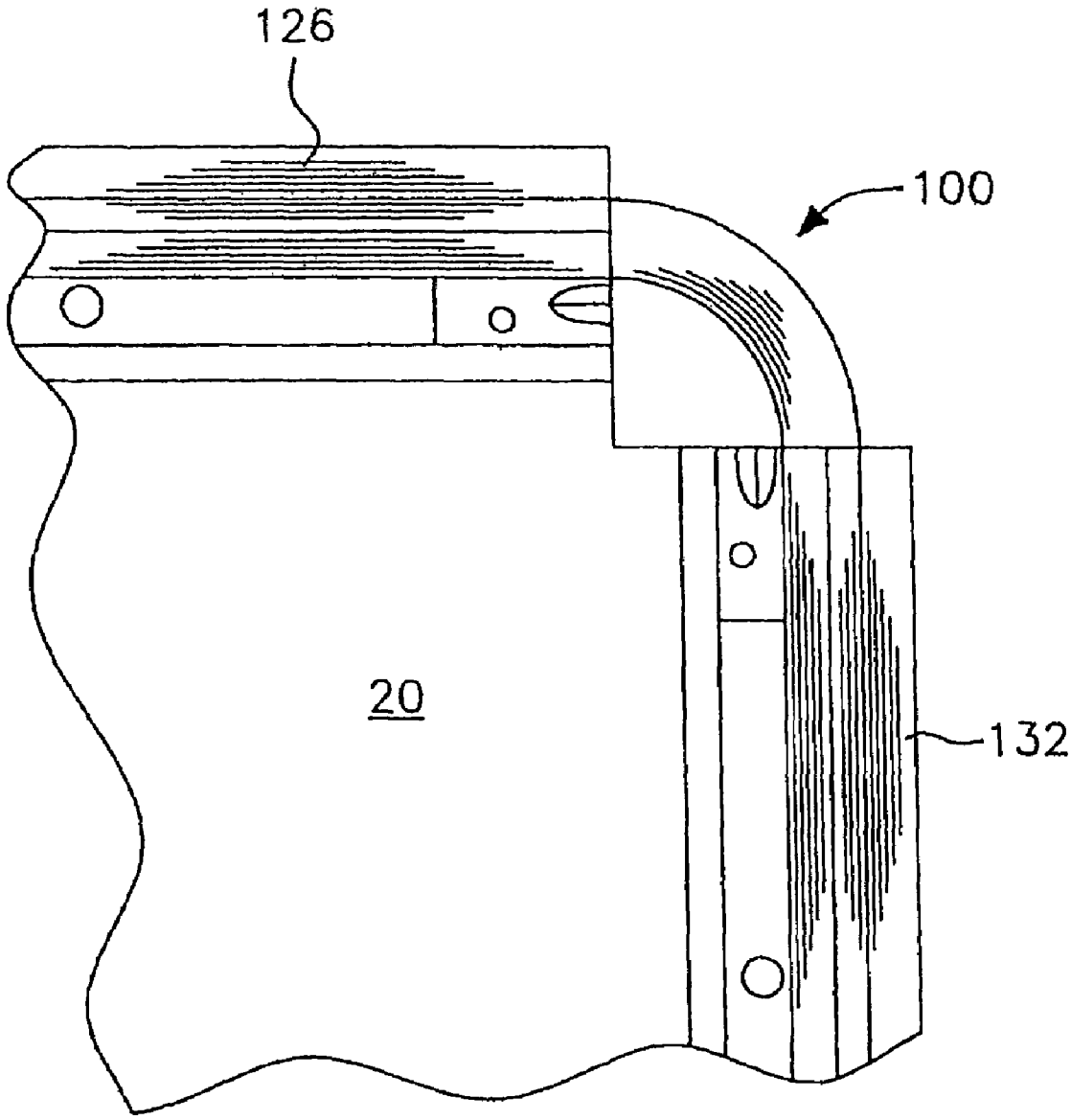
FIG. 5 is a front elevational view of an alternative rounded corner embodiment of the invention.

FIG. 5 illustrates an alternative arrangement comprising a rounded corner assembly, which can be used on all four corners instead of the square corner arrangement of the embodiment of FIGS. 1 through 4. Only one such corner 100 is illustrated; however, it should be understood that the other corners would be identical in construction. The modified construction necessarily includes pivotal clamp members 126 and 132, which are reduced in length as compared to the corresponding clamp members 26 and 32 of the first embodiment. While not shown, the modified embodiment would also use reduced length clamp members in place of clamps 28 and 30 of the first embodiment.

Figure 6:
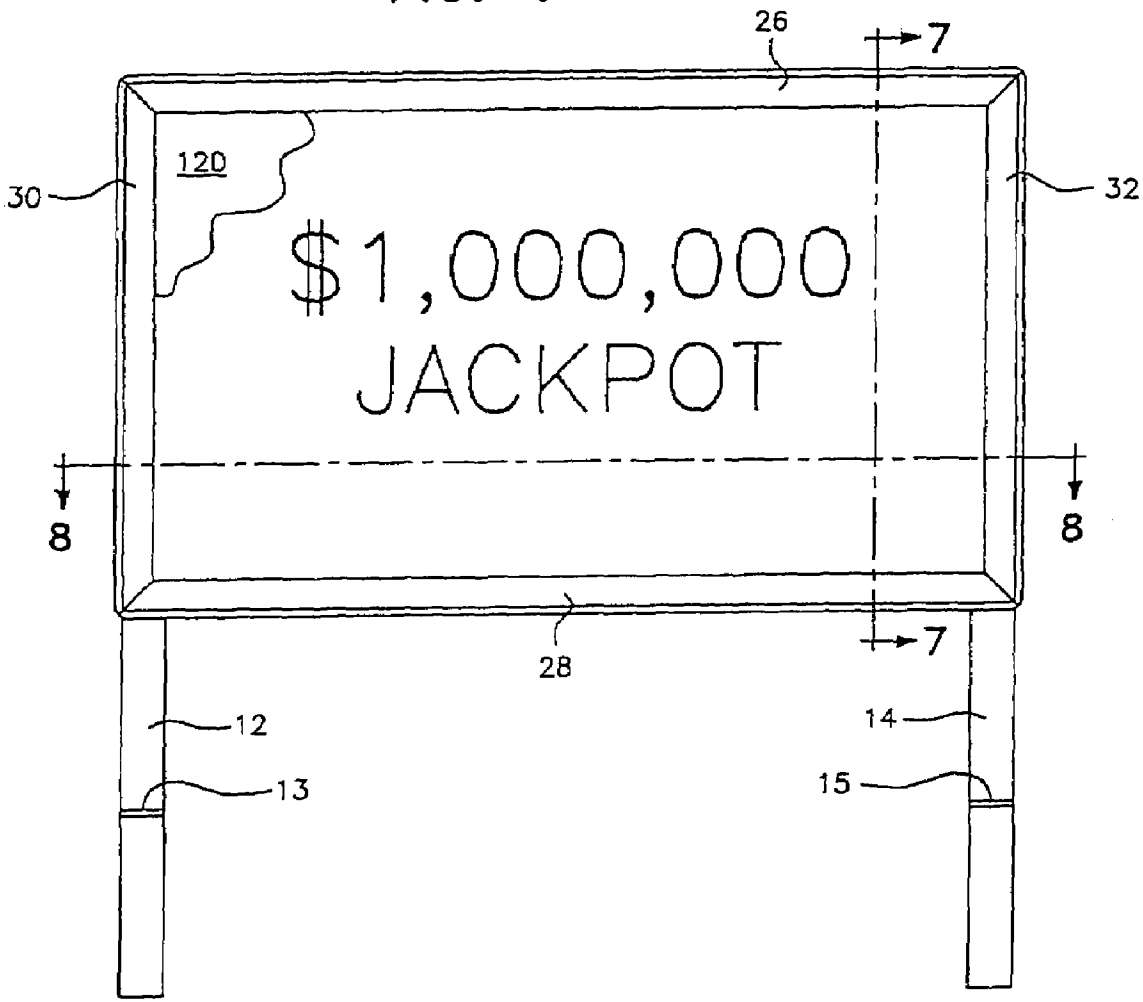
FIG. 6 is a front elevation of a back-lit display in accordance with a second embodiment of the invention.
Figure 7:
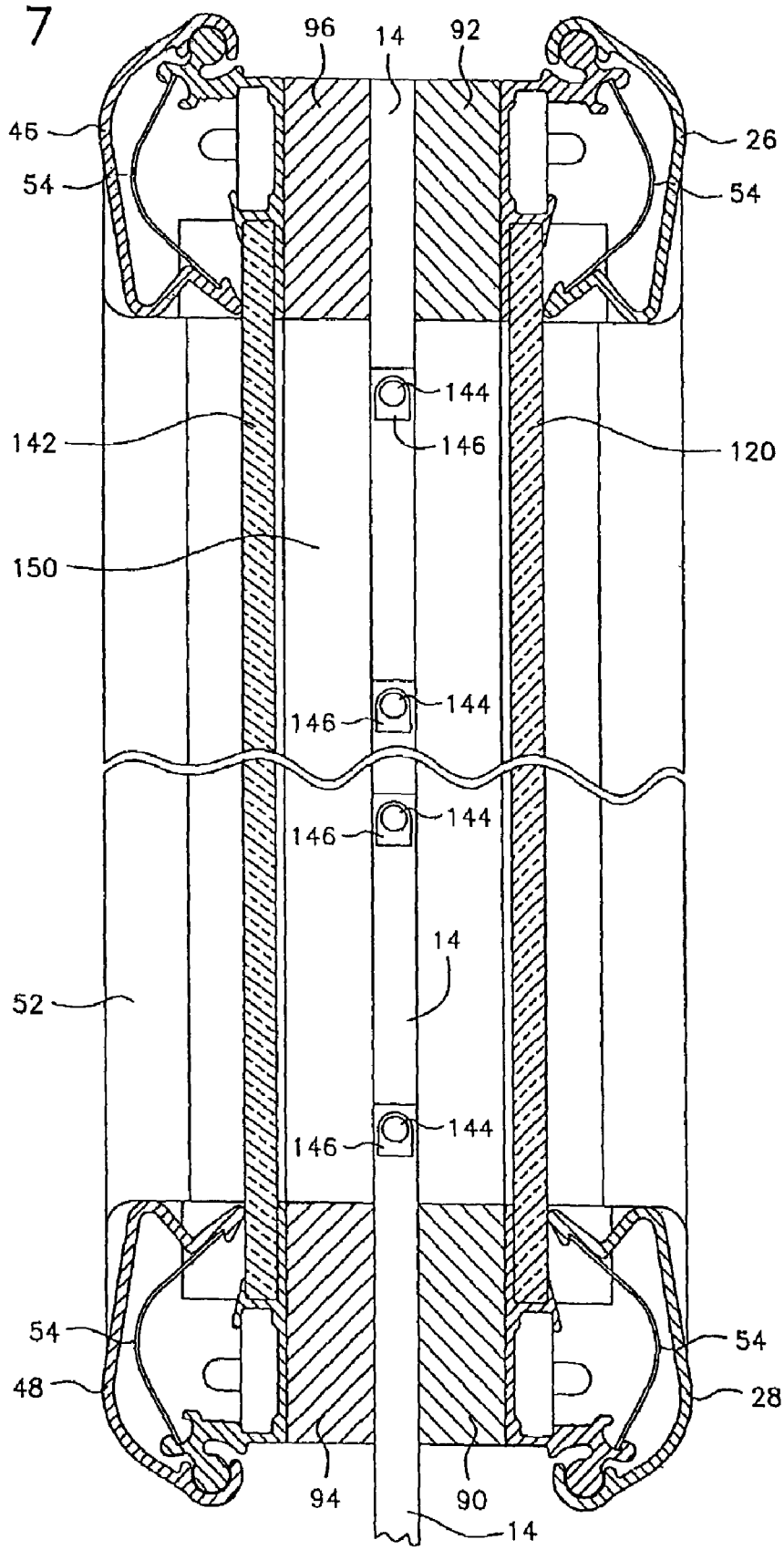
FIG. 7 is a sectional view of the display illustrated in FIG. 6 taken along line 7-7 thereof.
Figure 8:
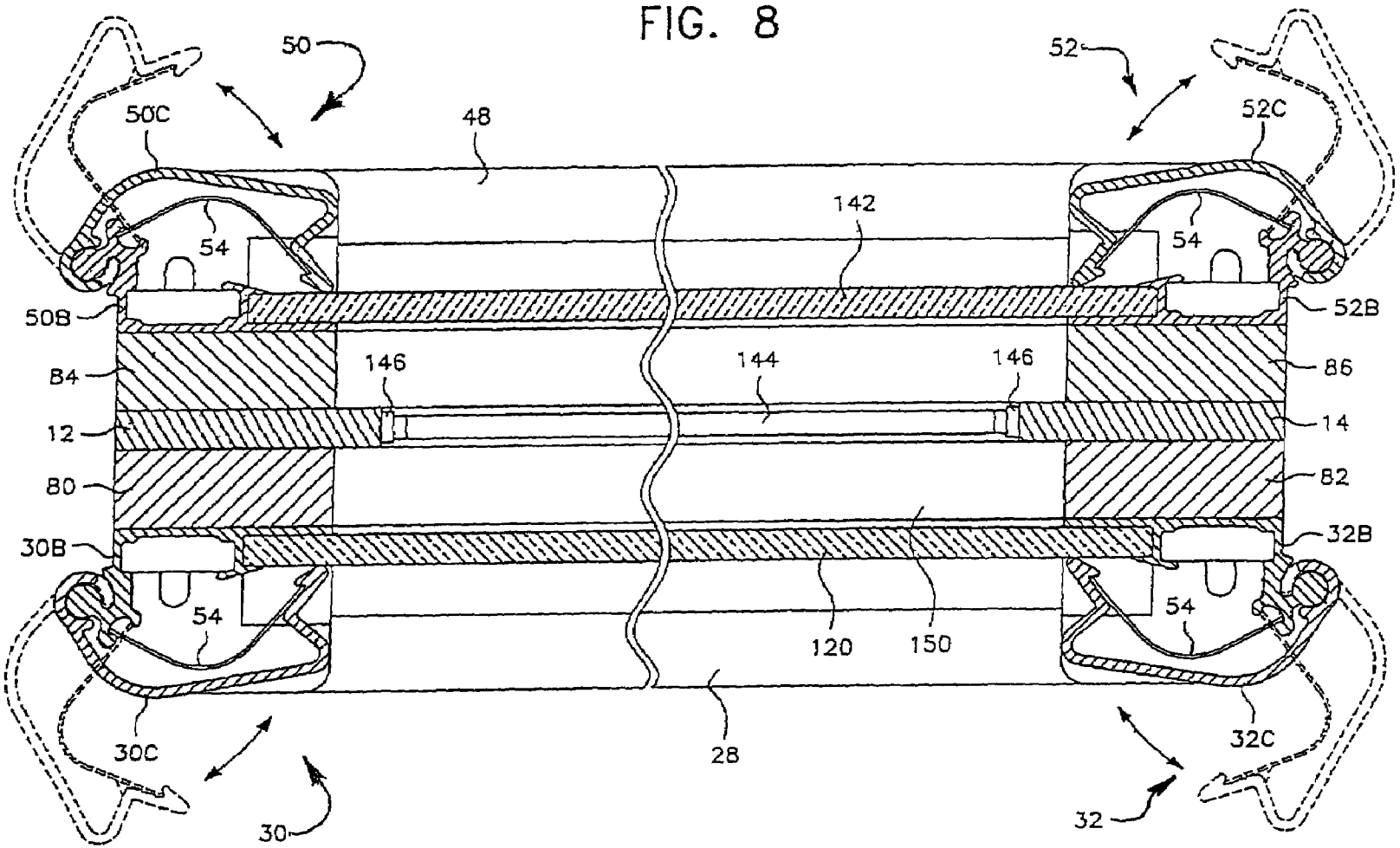
FIG. 8 is a sectional view of the display illustrated in FIG. 6 taken along line 8-8 thereof.

FIGS. 6-8 illustrate an alternative back-lit embodiment of a display of the invention. This display is similar to the embodiment display illustrated in FIGS. 1-4 and described above. In this embodiment, however, a front translucent plastic display support panel 120 is provided in place of the support panel 20 of the first embodiment, and a rear translucent plastic display support panel 142 (see FIG. 7) is provided in place of rear support panel 42 of the first embodiment. Additionally, a plurality of fluorescent light tubes 144 are positioned internally of the space between the translucent plastic display support panels 120 and 142 as shown in FIGS. 7 and 8. Each of the fluorescent light tubes 144 is supported at each end by a conventional fitting 146 mounted on the inwardly facing surfaces of legs 12 and 14 in the manner illustrated in FIG. 8. Electrical current is supplied to the fluorescent tubes in a conventional manner. It should be understood that the use of fluorescent tubes is not mandatory for practice of the invention since other conventional light sources could also be used if desired.

The back-lit embodiment of FIGS. 6, 7 and 8 also differs from the first embodiment by the inclusion of front vertical spacer plates 80 and 82 attached to the front surfaces of legs 10 and 12 and rear vertical spacer plates 84 and 86 which are attached to the rear faced surfaces of legs 12 and 14 as shown in FIG. 8. Similarly, front horizontal spacer plates 90 and 92 extend between the front surfaces of each of the vertical legs 12 and 14 as shown in FIG. 7 and identical rear horizontal spacer plates 94 and 96 extend between legs 12 and 14 and are connected to the rear surfaces of legs 12 and 14. The spacer plates separate the front and rear clamp assemblies sufficiently to provide a space 150 of sufficient front to rear dimension between the translucent plastic display support panels 120 and 142 to easily receive the fluorescent tubes 144 as shown in FIGS. 7 and 8.

FIGS. 9-15 illustrate yet another embodiment display 200 of the invention. This embodiment is again a back-lit display similar to that illustrated in FIGS. 6-8. This embodiment display, however, has a thin profile design.

Figure 9:
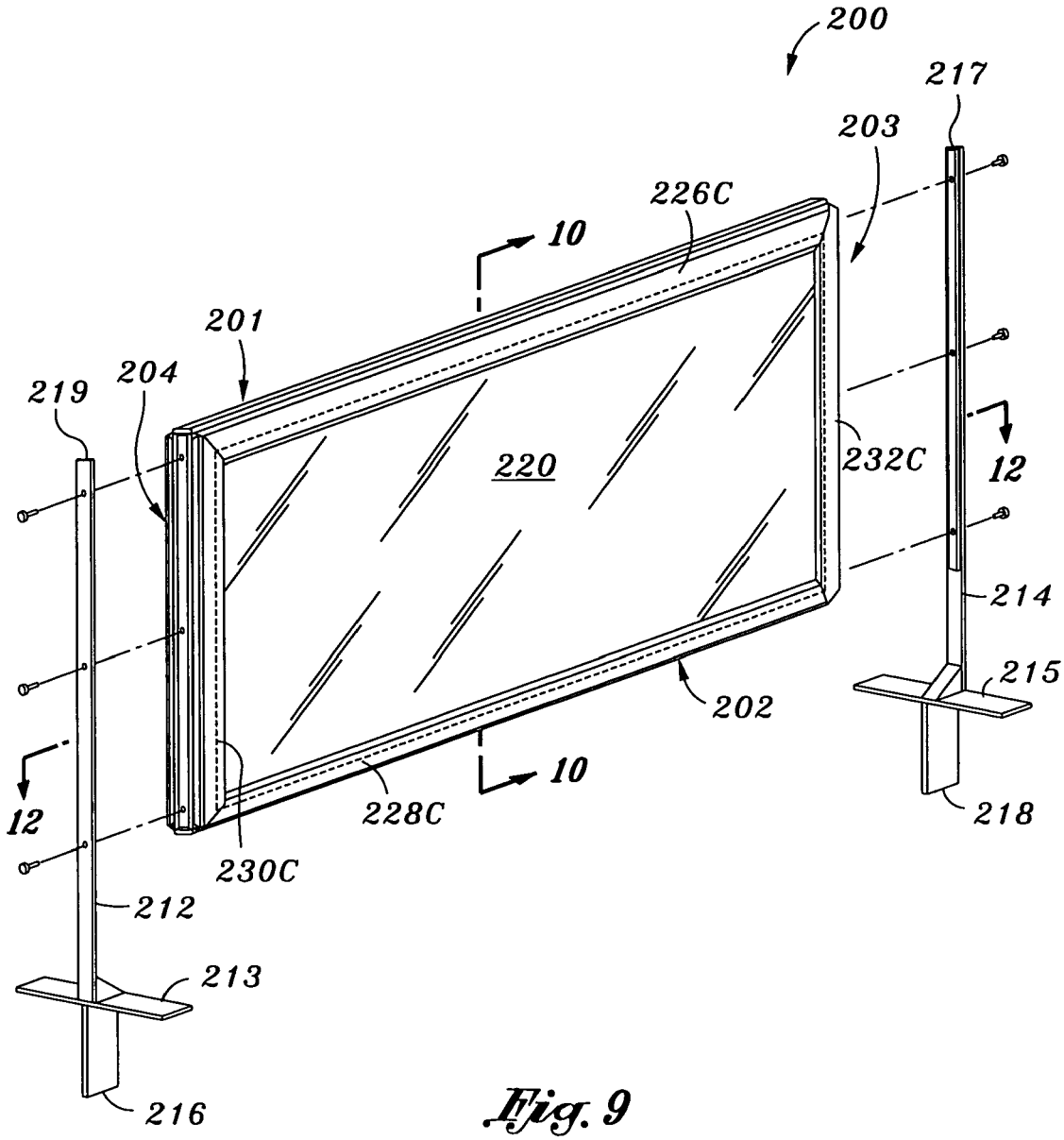
FIG. 9 is a perspective view of a thin back-lit display in accordance with yet another embodiment of the invention.

The display 200 is again preferably configured for location between back-to-back rows of gaming or vending machines or the like. For that purpose, as shown in FIG. 9, the display 200 is supported by first and second legs 212,214. In the preferred embodiment, these legs 212,214 are located at opposing ends of the display 200. Cantilevered stops, such as struts or supports 213,215, extend outward in similar manner to the displays detailed above.

Figure 10:
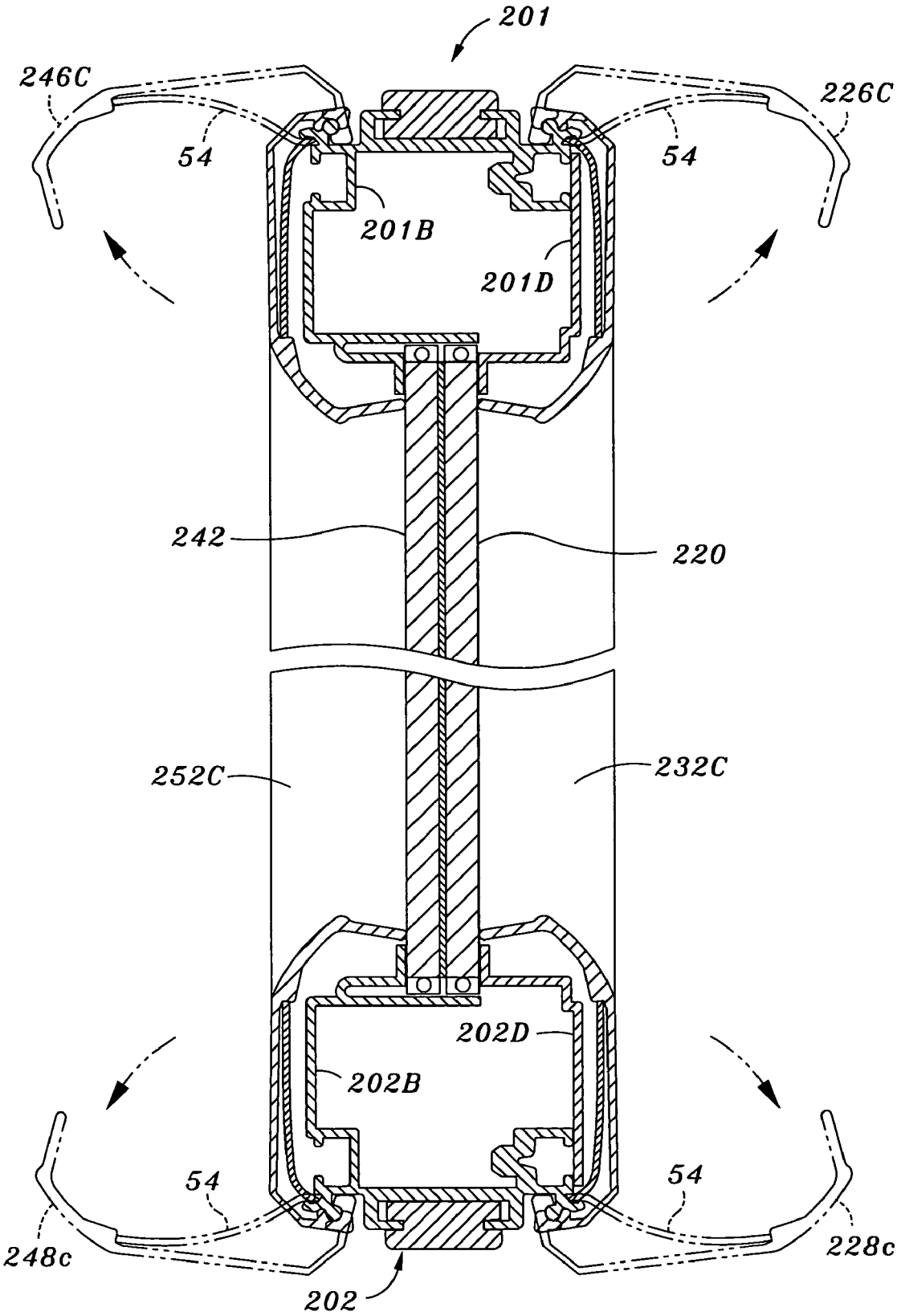
FIG. 10 is a sectional view of the display illustrated in FIG. 9 taken along line 10-10 thereof.

As illustrated in FIG. 10, the display 200 is preferably "bi-directional," meaning that it has a first or front display panel 220 and a generally opposing second or rear display panel 242; The display 200 further includes a visual display support border frame. The frame preferably surrounds and supports the translucent display panels 220,242 and supports clamping means for securing signage, such as display graphics, over the display panels. In one embodiment, the border frame comprises an upper/top frame member 201, a lower/bottom frame member 202, a first side frame member 203 and a second side frame member 204.

The border frame members 201, 202, 203 and 204 maybe constructed in a variety of fashions. In one embodiment, the border frame members 201, 202, 203, 204 comprise base members 201B, 202B, 203B and 204B which are configured to receive and retain the edges of the display panels 220,242. In one embodiment, the base members 201B, 202B, 203B, 204B are constructed from extruded metal.

In one embodiment, signage maybe located over the panels 220,242. To facilitate the location of the signage, the base members 201B, 202B, 203B, 203B preferably pivotally support corresponding sheet clamps 226C, 228C, 230C, 232C, 246C, 248C, 250C and 252C. Preferably, each of the sheet clamps 226C, 228C, 230C, 232C, 246C, 248C, 250C and 252C may be moved into either a clamping position (shown in solid lines) or an open position (shown in dashed lines). In one embodiment, means are provided for biasing the sheet clamps into one or both of these positions. This means may comprise an over-center biasing spring 54 which urges its respective sheet clamp 226C, 228C, 230C, 232C, 246C, 248C, 250C, 252C towards both positions when manually moved past an over-center position.

Figure 11:
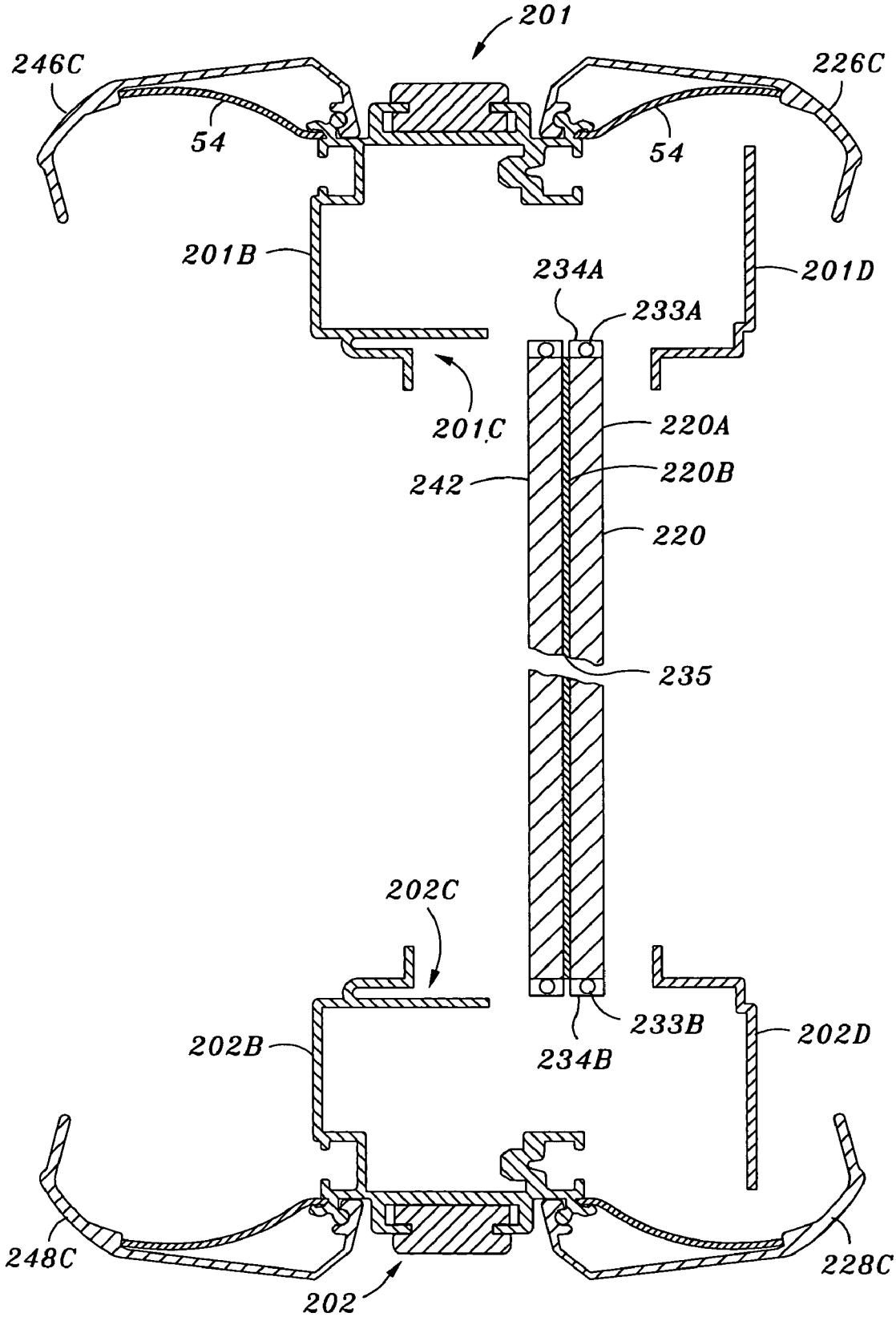
FIG. 11 is an exploded assembly view of the portion of the display illustrated in FIG. 10.

FIG. 11 illustrates the front display panel 220 and the rear display panel 242 in a cross-sectional side view. As illustrated, in a preferred embodiment, the panels 220,242 are placed back-to-back. The display panels 220, 242 are supported in a pair of rectangular cavities 201C, 202C that are defined by the upper frame member 201 and lower frame member 202, respectively. The display panels 220,242 are retained in cavities 201C,202C by frame retention members 201D and 202D which capture the display panels there between. The retention members 201D and 202D are secured to their respective base member 201B, 202B, such as by a suitable fastener such as a screw, bolt, rivet or press fit connector.

The front display panel 220 is preferably an edge-lit translucent diffusion panel fabricated from an acrylic polymer. One commercially available example of the display panel is the Luminaire Ultra® III distributed by Clearr Corporation of Minneapolis, Minn. In one embodiment, the front display panel 220 has a first, front or exterior surface 220A and a generally opposing second, rear or interior surface 220B. The display panels 220,242 have an outer edge or periphery. In a preferred embodiment, the edge of each display panel 220, 242 has a top portion, a bottom portion and first and second side or end portions corresponding to the portions of the display frame. The edges define surfaces which preferably extend generally perpendicular to the front and rear surfaces.

Preferably, each display panel 220,242 is "edge-illuminated." In this configuration, at least one light source is configured to direct or provide light at edge of each display panel 220,242. Additionally, the light source is geometrically positioned in the same plane as the display panel.

In one embodiment, a light source is located at the top and bottom of the first display panel 220. As illustrated, a first light source 233A and an associated first light reflector 234A are located at a top of the panel 220, and a second light source 233B and a second light reflector 234B are located at the bottom of the panel 220. The light sources 233A, 233B are preferably coupled to the edges of the display panel 220 using the light reflectors 234A, 234B, and thus provide an edge illumination source. Each edge of the display panel 220 is capable of supporting a light source and reflector assembly to provide sufficient illumination as needed for different display panel sizes (i.e. a light source may be associated with the side edges as well as the top and bottom edges of the panel 220, or the side rather than the top and bottom edges).

In one specific example, the light sources 233A,233B each comprise a cold-cathode flourescent lamp (CCFL). However, other types of light emitting devices can be used, such as LEDs, fiber optic strands, neon tubes and the like. The electrical power supplies for the various light sources are well known and are not discussed in detail so as not to obscure the invention.

In one configuration, the second/interior surface 220B of the display panel 220 has a plurality of engraved V-shaped grooves (not shown for figure clarity) excised thereon and running in both display panel dimensions. The grooves are designed to capture and reflect light from the light sources 233A,233B and redirect the light towards a reflective sheet or surface 235. The light is then reflected and redirected from the reflective sheet 235 through the translucent display panel towards the first/exterior surface 220A, thus causing the display panel 220 to be illuminated very evenly across its front or display surface.

In another embodiment, the groove spacing parallel to the light sources decreases as the distance from the light source increases, resulting in an increased density of grooves. The increased density of grooves provides additional reflective surface area and normalizes the light distribution to reduce shadows and hot spots (which are inherent in conventional backlit displays).

Similarly, the second or rear display panel 242 is configured and functions essentially the same as the first or front display panel 220 previously discussed. In one configuration, the front and rear display panels are separated by a dual sided reflective sheet 235 which provides a reflective surface for redirecting light through the translucent display panels. In another configuration, each panel 220,242 may be provided with a reflective sheet.

Figure 12:
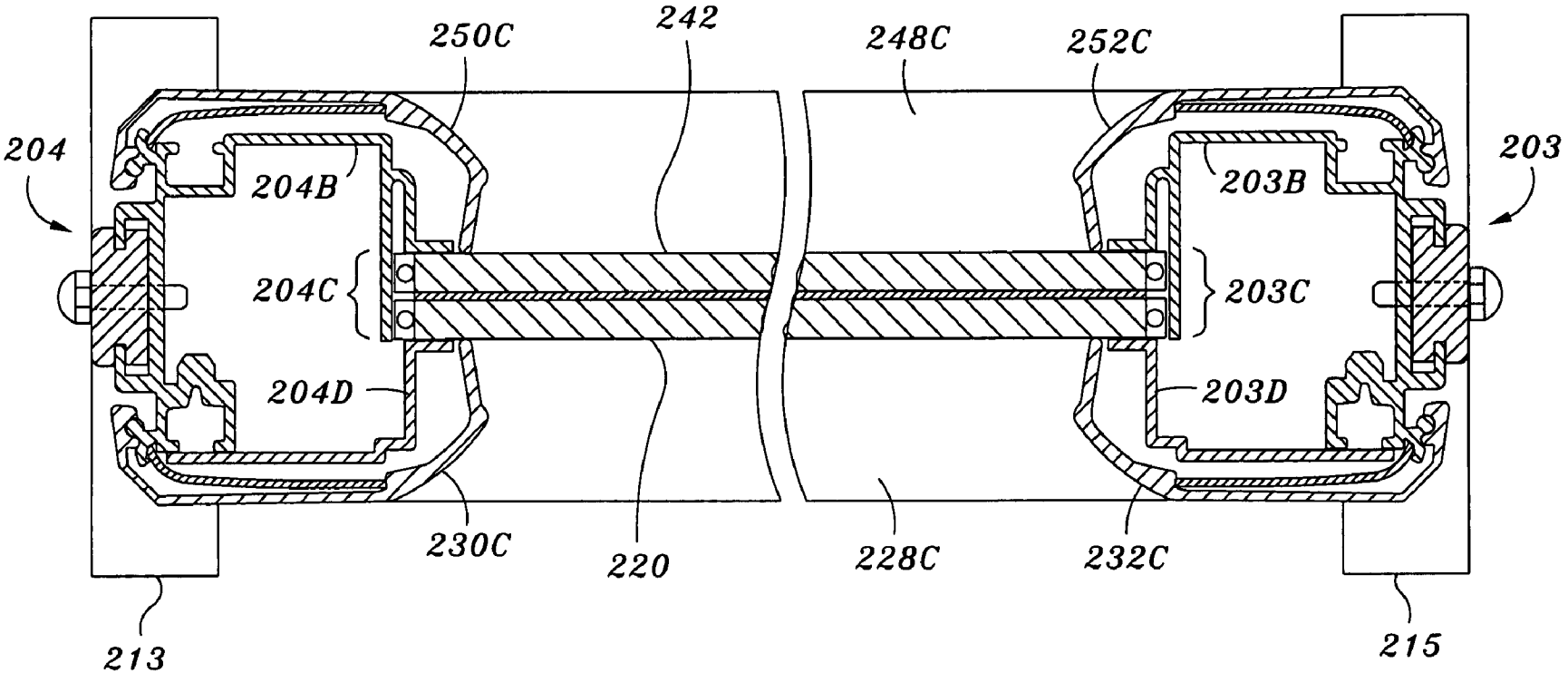
FIG. 12 is a sectional view of the display illustrated in FIG. 9 taken along line 12-12 thereof.

FIG. 12 illustrates a horizontal section view of the display panel 200. In this figure, the first and second side frame members 203 and 204 provide similar structural support to the top and bottom frame members 201,202 as previously discussed with reference to FIGS. 10 and 11. These side frame members 203,204 similarly preferably define a first and a second rectangular cavity 203C,204C for accepting side portions of the display panels 220,242. The display panels 220,242 are retained in cavities 203C,204C by frame retention members 203D,204D which capture the display panels there between. The retention members 203D,204D are secured to their respective base member, such as by a suitable mechanical fastener such as a screw, bolt, rivet or press fit connector.

Figure 13:
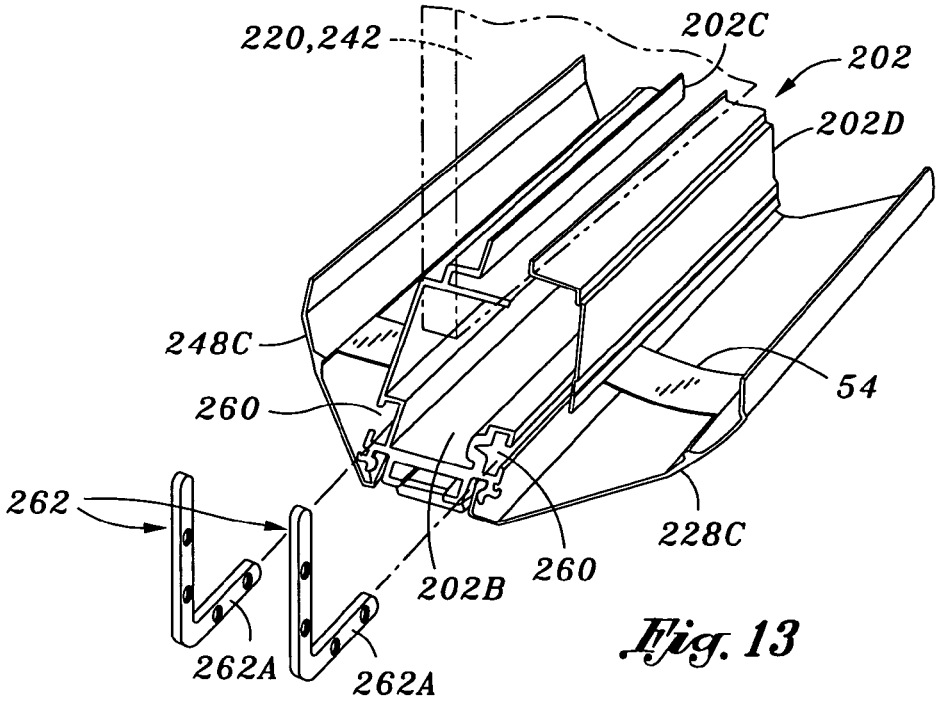
FIG. 13 is a perspective view of a frame end and an associated pair of connecting L-brackets of the display illustrated in FIG. 9.
Figure 14:
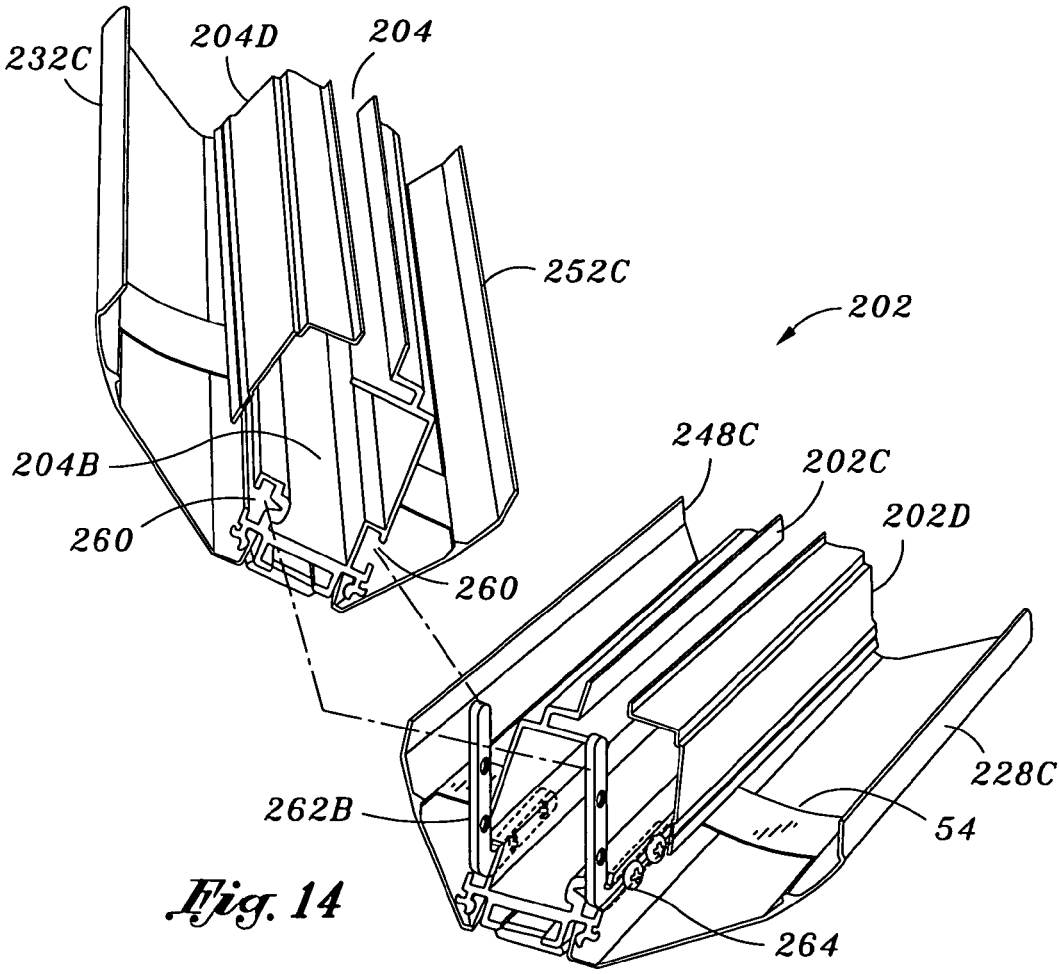
FIG. 14 is an exploded perspective assembly view of a corner portion of the frame of the display illustrated in FIG. 9.
Figure 15:
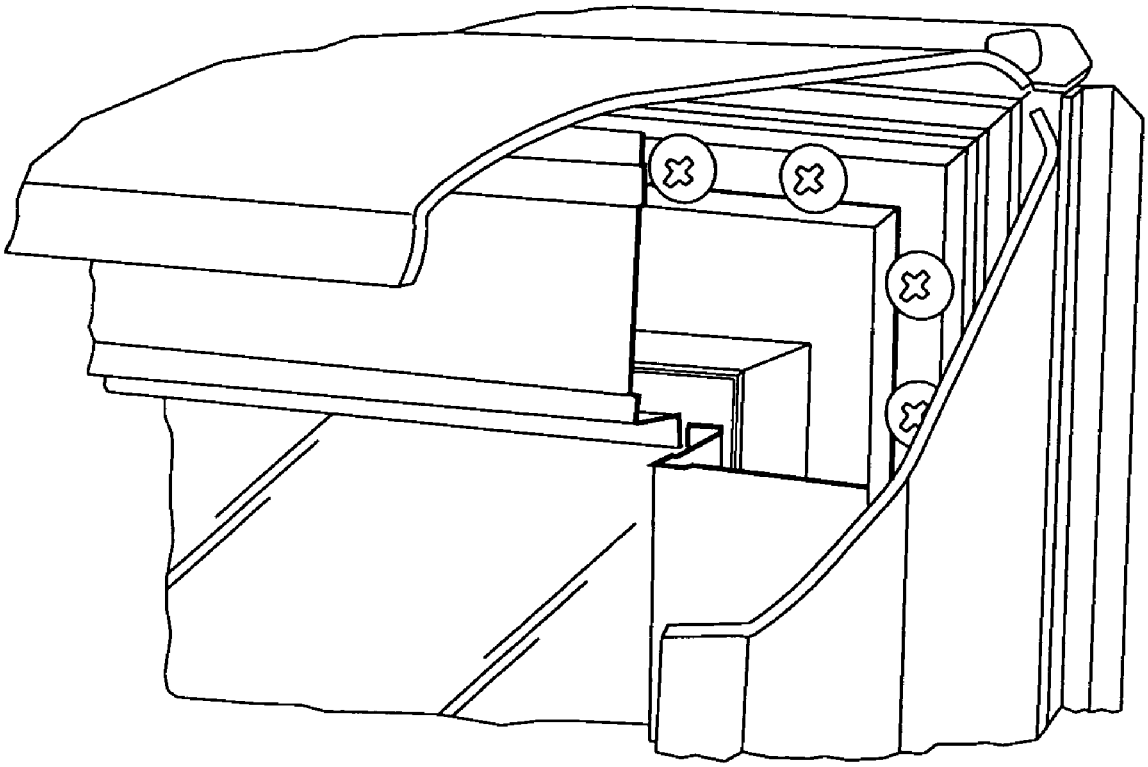
FIG. 15 is a partially cut-away perspective view of an assembled corner portion of the frame of the display illustrated in FIG. 9.

As detailed above, in one embodiment, the display frame is comprised of top, bottom, and side frame members 201, 202, 203, 204 which are connected to one another. One embodiment of a configuration of the connection of these members will be described with reference to FIGS. 13 and 14. These figures illustrate the connection between the bottom member 202 and one of the side members 204. It should be understood that a similar connection is preferably utilized at each of the corners of the frame, thus joining the four frame members 201,202,203,204. As illustrated, the base member 202B of the bottom frame member 202 has a pair of slots 260 integrally formed thereon, each slot sized/shaped to releasably retain a first leg 262A of an L-bracket 262. As shown in FIG. 14, the base member 204B of the side frame member 204 likewise has a pair of slots 260 integrally formed thereon, each slot sized/shaped to releasably retain a second leg 262B of the L-bracket 262. The L-brackets 262 are secured to the base members by fastening means, such as a threaded machine screw 264. The corner assembly just described and shown in FIGS. 13 and 14 is one example of a corner construction for the display 200. FIG. 15 illustrates one of the assembled frame corners of the display 200.

The frame members might be joined in other configurations, such as the use of a single L-bracket, by portions of the frame members overlapping or directly joining or the like. This particular configuration has the benefit that it maintains the frame members in tight and square connection. In addition, the configuration allows the frame members to easily be detached, such as for replacement or repair.

As indicated, the display of the invention is preferably "two-sided." The display could be one-sided. Also, the display may be two-sided while only including a single display panel (that panel having a front and a back). For example, a single display panel might be configured to be edge-illuminated and emit light from both the front and rear thereof.

While it is preferred that the display of the invention include legs for support it, the display might be wall mounted or the like.

The thin-profile display has numerous advantages over current visual displays, and has particular advantages when used with back-to-back rows of gaming or vending machines. In particular, this embodiment of the display of the invention (embodiment display 200) has a minimal depth dimension. In other words, the display is very thin. This contributes to the display having an aesthetic streamlined appearance. In addition, however, the display occupies very little space. As indicated, the display is particularly suited to being located between back-to-back gaming machines. Often, equipment such as gaming machine lights or "candles" as they are known in the art, are located at the top of the machines. The thin profile of the display permits the display to be located between the machines but without interfering with that equipment.

In one embodiment, the display may be as thin as 1.0-2.5 inches. The thin profile of the display is achieved by locating the display panels in back-to-back relationship. As described, in the embodiment display illustrated in FIG. 10, the depth of the display is reduced by eliminating the space between the panels which was necessary in the embodiment illustrated in FIG. 7 to locate the lights. In the embodiment in FIG. 10, the panels are back-to-back and illumination is provided at the edges of the panels (i.e. illumination is provided in the same plane as the panels, not in a plane between or in front of the panels). Further, the legs are preferably located at the sides of the display. This helps reduce the depth of the display, since additional depth is not needed to accommodate the legs (such as if the legs were located within the body of the display).

The embodiment display illustrated in FIG. 9 also has the advantage that it is uniformly illuminated. Thus, all portions of a poster or other element placed in front of the front or back display panels are uniformly illuminated. This ensures that information associated with the display, such as signage associated with one or both of the display panels is easy to read or view by consumers.

The display provides a convenient way for changing the visual display content. The content may be updated as desired to correspond to various events and specials. In a preferred embodiment, signage (such as a thin sheet or film of printed material, such as bearing text or graphics) may be located over one or both panels. This signage can be maintained in position using the clamping members, and can also easily be removed by releasing the clamping members. In another embodiment, it is possible to associate information, such as text and/or graphics, directly with the panels. For example, such information could be printed directly on the panel.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A visual display mounting assembly for positioning between gaming machines having a back and a top and arranged in back-to-back configuration, comprising:

a first light transmitting display panel and a second light transmitting display panel, said first and second display panels each having an interior surface and an exterior surface and a peripheral edge;

a visual display support having a border frame, said border frame comprising an upper frame member, a lower frame member, a first side frame member and a second side frame member, said border frame further comprising an integrally formed rectangular cavity, said peripheral edges of said first and second display panels located in said cavity so that said first and second display panels are retained in said border frame in a position that their interior surfaces are positioned adjacent one another, and including at least one light source positioned in said cavity of said border frame against a portion of said peripheral edge of said first and second display panels, whereby said panels are edge illuminated;

a first and a second supporting leg, said first supporting leg having a top and a bottom, a portion of said first supporting leg located adjacent said first end of said border frame and said second supporting leg having a top and a bottom, a portion of said second supporting leg located adjacent said second end of said border frame, said border frame mounted to said first and second legs for support, said bottom end of said first supporting leg extending downwardly beyond said lower frame member and configured to be positioned between opposing back portions of back-to-back gaming machines and said bottom end of said second supporting leg extending downwardly beyond said lower frame member and configured to be positioned between opposing portions of back-to-back gaming machines; and first and second transverse stop plates extending in generally opposing directions from each of said first and second supporting legs between said lower frame member and said bottoms of said legs, said first and second transverse stop plates configured to rest upon a top of back-to-back gaming machines to support said visual display mounting assembly in a display position above said machines.

2. The visual display mounting assembly in accordance with claim 1 wherein said first and second display panels are generally translucent.

3. The visual display mounting assembly in accordance with claim 2 wherein said first and second display panels are located at opposing sides of at least one reflective sheet and extend parallel to one another.

4. The visual display mounting assembly in accordance with claim 2 wherein said interior surface of said first and second display panels has a plurality of grooves configured to reflect light emitted by said at least one light source towards a reflective sheet, said reflective sheet captured between said first and second display panels.

5. The visual display mounting assembly in accordance with claim 2 wherein said reflective sheet comprises a dual-sided reflective surface.

6. The visual display mounting assembly in accordance with claim 4 wherein said grooves are decreasingly spaced apart with respect to the distance from a light emitting edge.

7. The visual display mounting assembly in accordance with claim 1 wherein said at least one light source comprises a cold-cathode fluorescent lamp.

8. The visual display mounting assembly in accordance with claim 1 wherein at least one first light source is associated with said first display panel and at least one second light source is associated with said second display panel.

9. The visual display mounting assembly in accordance with claim 1 wherein said frame members are fabricated from extruded metal and each comprise a base portion and a frame retention member.

10. The visual display mounting assembly in accordance with claim 1 wherein said border frame includes one or more pivotable clamp components which are operable relative to said exterior surface of said first display panel and said border frame includes one or more pivotable clamp components which are operable relative to said exterior surface of said second display panel.

11. A thin-profile visual display mounting assembly for association with a gaming machine placed in a back-to-back configuration, comprising:

a visual display support, said visual display support having a first end and a second end and comprising:

a first translucent display panel and a second translucent display panel extending generally parallel to one another and arranged in back-to-back relationship, said first and second translucent display panels having a front and a back surface and a generally rectangular peripheral edge comprising a top, a bottom, a first end, and a second end;

a border frame extending about said periphery of said first and second translucent display panels, said border frame defining a channel, said peripheral edge of said first and second translucent display panels located in said channel; and at least one light source positioned in said channel of said border frame against a portion of said peripheral edge of said first and second translucent display panels, whereby said at least one light source edge-illuminates said first and second translucent panels;

a first support leg having a top portion and a bottom portion, said top portion positioned at said first end of said visual display support and said bottom portion extending downwardly beyond said visual display support;

first and second transverse stop plates extending in generally opposing directions from said first support leg between said bottom portion thereof and said visual display support;

a second support leg having a top portion and a bottom portion, said top portion positioned at said second end of said visual display support and said bottom portion extending downwardly beyond said visual display support; and first and second transverse stop plates extending in generally opposing directions from said second support leg between said bottom portion thereof and said visual display support;

whereby when said bottom portions of said first and second support legs are positioned between back portions of opposing gaming machines and said first and second transverse stop plates extending from said first and second support legs engage top portions of said gaming machines, said visual display support is supported in an upright position above said gaming machines for viewing.

12. The visual display mounting assembly in accordance with claim 11 wherein said border frame includes one or more pivotable clamp components which are openable relative to said exterior surface of said first and second translucent panels.

13. The visual display mounting assembly in accordance with claim 11 wherein said at least one light source comprises a cold-cathode fluorescent lamp.

14. The visual display mounting assembly in accordance with claim 11 wherein said border frame defines a cavity for accepting at least a portion of said edge of said first and second translucent display panels.

15. The visual display mounting assembly in accordance with claim 11 wherein a plurality of grooves are located at an interior portion of each of said first and second display panels.

16. The visual display mounting assembly in accordance with claim 11 including at least one reflective sheet positioned between said first and second display panels.

17. The visual display mounting assembly in accordance with claim 11 wherein said first and second support legs are generally planar metal plates having a first side and an opposing second side and a thickness less than a space between said backs of said opposing gaming machines between which said legs are positioned.

* * * * *